US005979430A

United States Patent [19]

Peed et al.

[11] Patent Number: 5,979,430

[45] Date of Patent: Nov. 9, 1999

[54] SUPPLY DEVICE FOR GAS APPLIANCE MANIFOLD

[75] Inventors: Sherman Peed, Signal Mountain, Tenn.; John Dipaolo, Mansfield; Dennis Kerr, Ashland, both of Ohio

[73] Assignee: Universal Tubular Systems, Inc., Mansfield, Ohio

[21] Appl. No.: 09/020,016

[22] Filed: Feb. 6, 1998

[51] Int. Cl.[6] ..... F24C 3/00

[52] U.S. Cl. ..... 126/39 N; 431/280; 137/883; 29/890.08

[58] Field of Search ..... 126/39 N, 39 R, 126/39 E, 19 R, 1 R; 137/883, 625; 431/278, 280; 239/562; 285/901, 222; 138/89, 94; 29/890.08, 890.052

[56] References Cited

U.S. PATENT DOCUMENTS

| | | | |
|---|---|---|---|
| 2,304,140 | 12/1942 | Bergholm | 126/39 N |
| 2,321,169 | 6/1943 | Tullis | 126/39 R |
| 2,450,744 | 10/1948 | Whitehead | 126/39 N |
| 2,626,634 | 1/1953 | McDowell | 137/883 |
| 2,658,987 | 11/1953 | Ogden | 126/39 R |
| 2,793,421 | 5/1957 | Brumhaugh | 29/890.08 |
| 2,896,975 | 7/1959 | Wahl et al. | 126/39 N |
| 3,298,716 | 1/1967 | Taylor et al. | 285/55 |
| 3,470,893 | 10/1969 | Nelson | 137/883 |
| 3,700,378 | 10/1972 | Scheid | 126/39 R |
| 3,804,118 | 4/1974 | Love et al. | 137/883 |
| 3,871,063 | 3/1975 | Halvorsen | 29/890.143 |
| 3,884,413 | 5/1975 | Berquist | 431/280 |
| 4,627,411 | 12/1986 | Mertler | 126/39 E |
| 4,705,018 | 11/1987 | Beach | 126/39 N |
| 4,754,744 | 7/1988 | Borg | 126/39 N |
| 4,794,907 | 1/1989 | Corliss et al. | 126/39 R |
| 4,929,001 | 5/1990 | Phillips, II | 285/222 |
| 5,044,352 | 9/1991 | Lok | 126/39 R |
| 5,172,762 | 12/1992 | Shinmura et al. | 29/890.052 |
| 5,209,217 | 5/1993 | Beach et al. | 126/39 R |
| 5,311,895 | 5/1994 | Martin | 137/883 |
| 5,464,145 | 11/1995 | Park et al. | 29/890.052 |
| 5,496,141 | 3/1996 | Popsys | 138/89 |
| 5,711,663 | 1/1998 | Giebel et al. | 126/39 R |
| 5,829,425 | 11/1998 | Woods et al. | 126/39 R |
| 5,833,280 | 11/1998 | Ferlin et al. | 285/330 |
| 5,836,296 | 11/1998 | Hillis et al. | 126/39 R |
| 5,851,110 | 12/1998 | Ridenour | 126/39 N |

*Primary Examiner*—Ira S. Lazarus
*Assistant Examiner*—Josiah C. Cocks
*Attorney, Agent, or Firm*—Pearne, Gordon, McCoy & Granger LLP

[57] ABSTRACT

A gas appliance includes a pair of separate manifolds which each supply gas to two burner assemblies. Each manifold includes a relatively short and straight steel tube having a central section with a generally square-shaped cross-section and end sections with generally circular-shaped cross-sections, and a pair of end plugs closing the end sections to form a sealed interior space. The end plugs and the tube are swaged together at the end sections to form a gas-tight seal. A pair of bolt-through type valves are associated with each of the manifolds to regulate flow of gas from the manifolds to the burner assemblies. The valves have inlets directly secured to the manifolds and outlets connected to the burner assemblies with burner tubes. A pair of light-weight aluminum supply tubes connect a gas inlet with the two manifolds. The supply tubes are preferably secured to the manifolds with bolt-through type adapters located at the longitudinal centers of the manifold tubes and between the two valves.

33 Claims, 4 Drawing Sheets

SUPPLY DEVICE FOR GAS APPLIANCE MANIFOLD

BACKGROUND OF THE INVENTION

The present invention generally relates to a distribution system for a gas appliance and, more particularly, to such a distribution system having a plurality of relatively small manifolds.

As shown in FIG. 1, gas appliances such as ranges and stoves typically have a plurality of manually operable valves 10 which respectively regulate the flow of gas through burner tubes 12 to a plurality of burner assemblies 14. The burner tubes 12 are typically connected to the burner assemblies 14 and the valves 10 with conventional flare-type fittings. The valves 10 are typically mounted directly to the side of a manifold tube 16 and spaced apart along the length of the manifold tube 16. One end of the manifold tube 16 is connected to a gas supply 18 and the other end is flared and sealed in some manner such as welding so that the manifold tube 16 distributes gas to the valves 10 with an acceptable pressure drop.

To prevent leaks, the manifold tube 16 is often formed of steel and/or with a relatively large wall thickness. These steel manifold tubes 16, however, are particularly prone to weld seam leaks and rusting problems. The manifold tubes 16 are also relatively heavy because of the relatively large size required to extend from the gas supply 18 to each of the valves 10 and the thick walls. Typically, the manifold tube 16 extends for the full depth and the full width of the appliance (as shown in FIG. 1). Additionally, the manifold tube 16 typically includes several complex bends which are time consuming and expensive to produce. Furthermore, the manifold tube 16 is designed for a particular appliance and is typically unique to that appliance model. Therefore, a different manifold tube 16 must be designed and produced for each appliance model. Accordingly, there is a need in the art for an improved gas distribution system for a gas appliance which has a manifold tube which is relatively easy and inexpensive to produce, is relatively small and light weight, eliminates the need for bends, and is easily adapted to different appliances.

BRIEF SUMMARY OF THE INVENTION

The present invention provides a gas appliance having a gas distribution system which overcomes at least some of the above-noted problems of the related art. According to the present invention, the gas appliance includes a gas inlet, first and second manifolds, first and second gas supply tubes, a pair of first valves, a pair of second valves, burner assemblies, and burner tubes. Each of the manifolds form a sealed interior space therein. The first supply tube connects the gas inlet with the first manifold and the second supply tube connects the gas inlet with to the second manifold. The supply tubes are in fluid flow communication with the hollow interior space of the manifolds and supplies a flow of gas thereto from the gas inlet. The first valves have inlets connected to the first manifold and are in fluid flow communication with the hollow interior space of the first manifold. The second valves have inlets connected to the second manifold and are in fluid flow communications with the hollow interior space of the second manifold. The burner tubes connect each of the burner assemblies with an outlet of one of the first valves and the second valves. The plurality of small straight manifolds enable the gas distribution system to be relatively inexpensive to produce and relatively light weight. Additionally, the manifolds can easily be used in appliances having many different configurations.

According to another aspect of the present invention, the first valves and the second valves are each bolt-through type valves and bolt-through type adapters connect the first supply tube to the first manifold and the second supply tube to the second manifold. Preferably, the adapters are located generally at the longitudinal center of the manifolds and between the associated pair of valves. The adapters enable the supply tubes to be aluminum tubes which are lightweight and are relatively easy to form into the desired shape.

According to yet another aspect of the present invention, the manifold includes a tube and a pair of plugs. The tube has a central section, preferably with a generally square-shaped cross-section, and end sections, preferably with generally circular-shaped cross-sections. The end plugs close the end sections to form the sealed interior space within the tube and have an interference fit with the end sections of the tube to form a gas-tight seal therewith. Preferably the end sections and the end plugs are swaged together. The manifolds, therefore, are relatively inexpensive to produce, have gas-tight seals formed with no welds, and have planar walls suitable for attaching bolt-through valves and adapters.

According to a further aspect of the invention, the manifolds are produced by first cutting a tube to a desired length and then forming end sections at ends of the cut tube. Preferably, the end sections are formed by inserting a mandrel into the tube and the end sections preferably have a generally circularly-shaped cross-section. Plugs are inserted into the end sections of the tube and the plugs and the tube are sealed together to form a gas-tight seal therebetween and a sealed interior space within the tube. Preferably, the plugs and the tube are swaged together.

BRIEF DESCRIPTION OF THE SEVERAL VIEWS OF THE DRAWING

These and further features of the present invention will be apparent with reference to the following description and drawings, wherein.

DETAILED DESCRIPTION OF PREFERRED EMBODIMENTS

Figure 1:
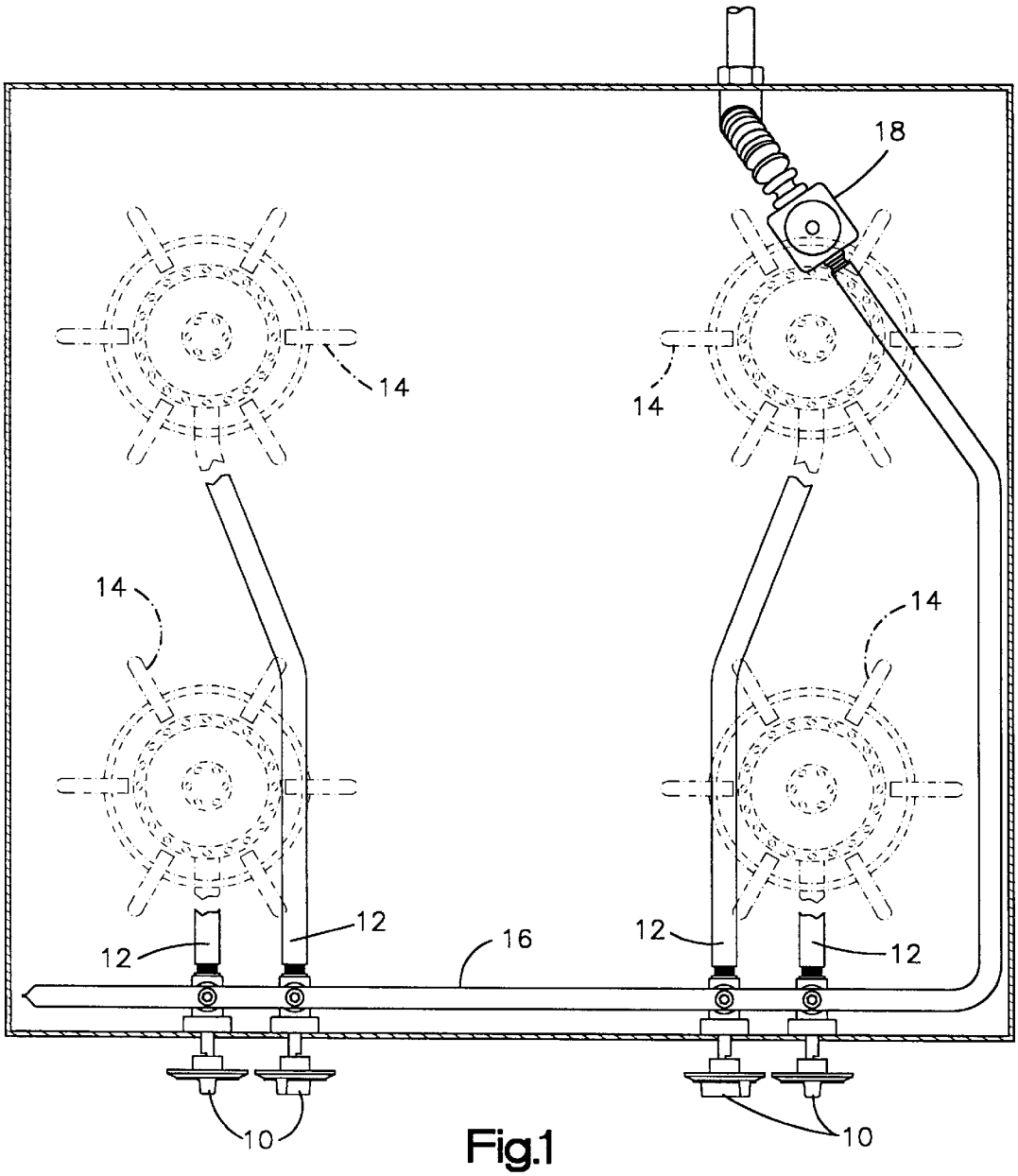
Fig.1 (PRIOR ART)
FIG. 1 is a plan view of gas appliance having a gas distribution system according to the prior art.
Figure 2:
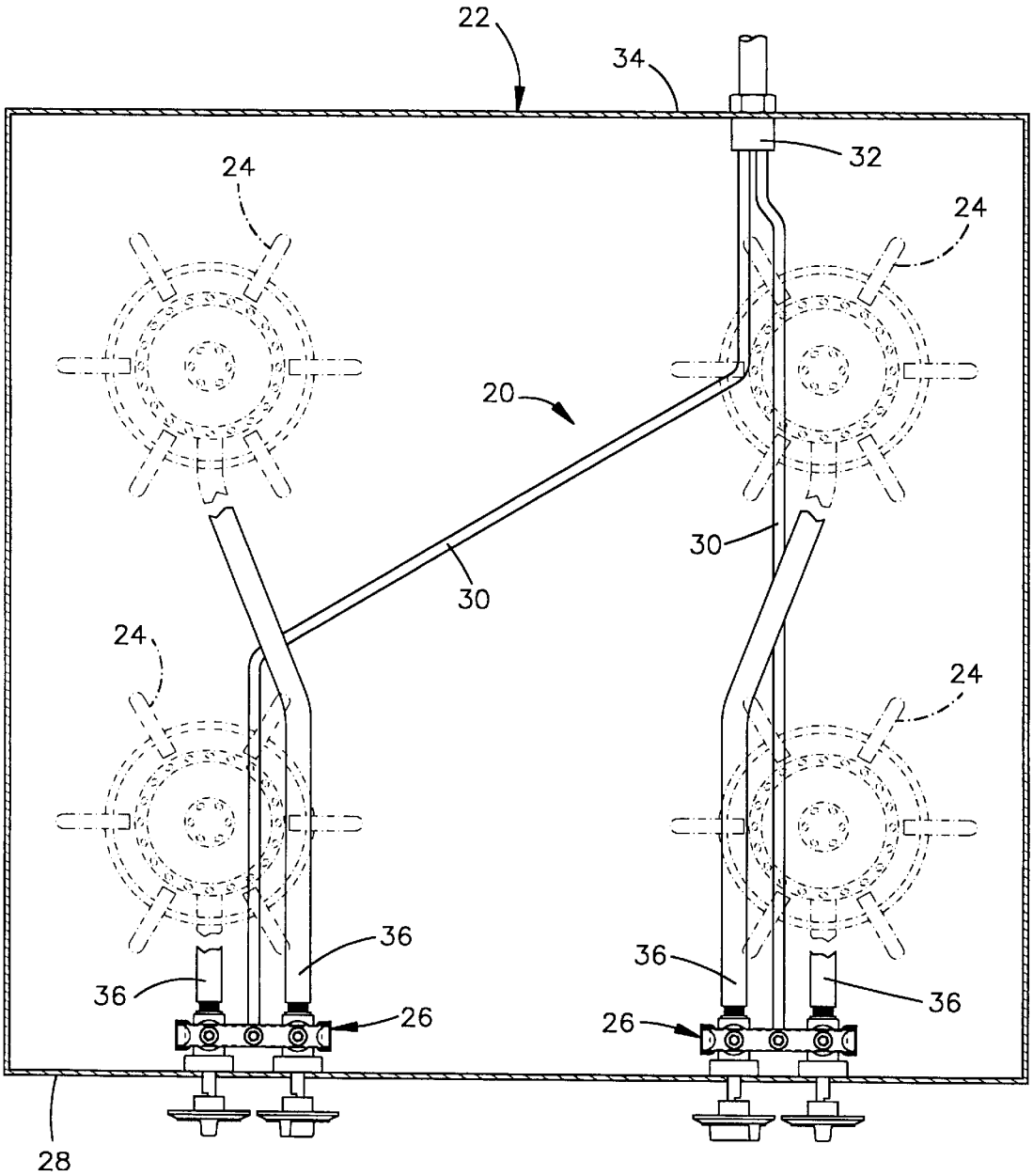
FIG. 2 is a plan view of a gas appliance having a gas distribution system with multiple small manifolds which supply gas to the burners according to the present invention.

FIG. 2 illustrates a gas distribution system 20 according to the present invention for a gas appliance 22 such as a range, stove, or the like. The gas appliance 22 of illustrated embodiment is a range having four top burners 24 in a generally rectangular-shaped pattern. It is noted, however, that the distribution system 20 is easily adapted to accommodate other numbers or configurations of top burners 24 within the scope of the present invention as described in more detail hereinbelow.

The illustrated distribution system 20 includes a pair of manifold assemblies 26 located at a front wall 28 of the appliance 22, separate gas supply tubes 30 connecting a gas inlet line 32 located at a rear wall 34 of the appliance 22 to the manifolds assemblies 26, and separate outlet or burner tubes 36 connecting the top burners 24 to the manifold assemblies 26. Each manifold assembly 26 has two of the top burners 24 connected thereto. It should be apparent that the quantity of the manifold assemblies 26 can be easily adjusted to accommodate a different number of the top burners 24. For example, an appliance 20 having two top burners 24 could utilize only one of the manifold assemblies 26 and an appliance 20 having six top burners 24 could utilize three of the manifold assemblies 26.

Figure 3:
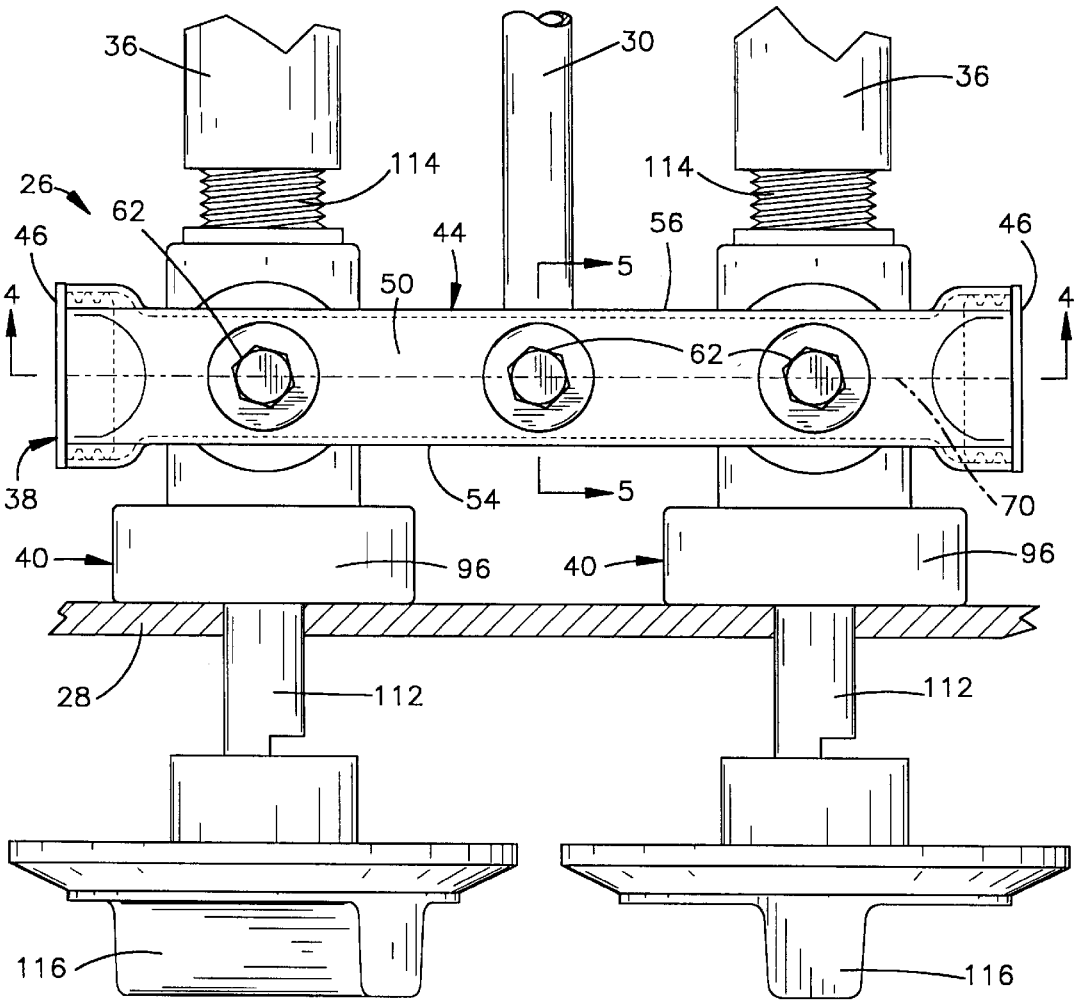
FIG. 3 is an enlarged view of one of the manifolds of FIG. 2.
Figure 4:
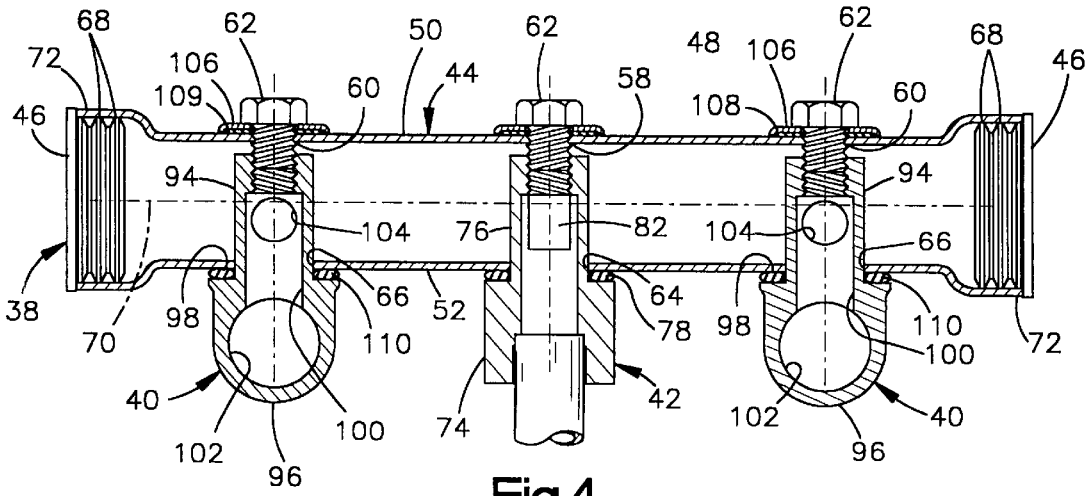
FIG. 4 is a cross-sectional view taken along line 4—4 of FIG. 3 and showing the manifold with connections thereto.
Figure 5:
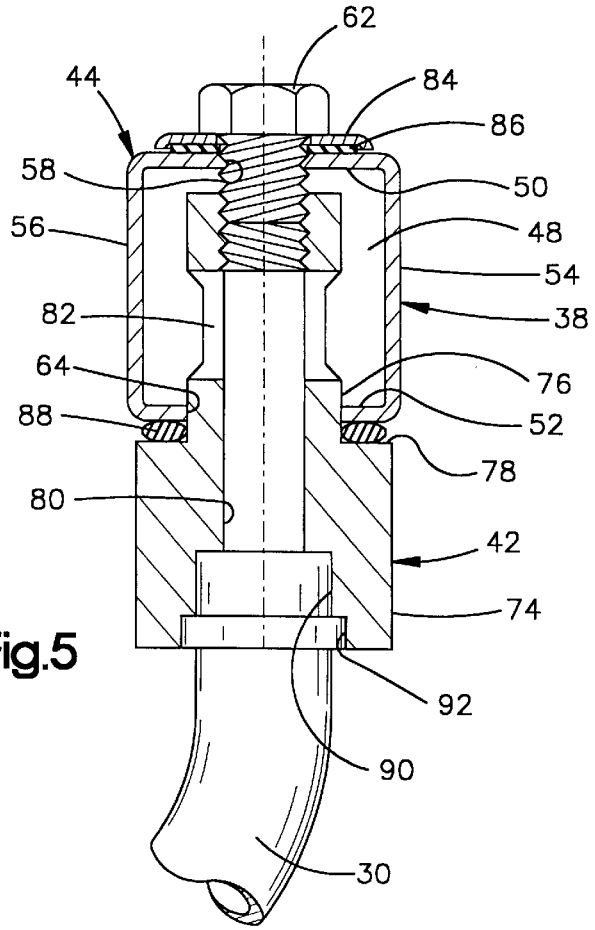
FIG. 5 is an enlarged cross-sectional view taken along line 5—5 of FIG. 3 and showing a connection between the manifold and a gas supply tube.

As best shown in FIGS. 3–5, each manifold assembly 26 includes a manifold 38, a pair of valves 40 for securing two of the burner tubes 36 to the manifold 38 and selectively regulating the flow of gas from the manifold 38 to the two burner tubes 30, and an inlet fitting or adapter 42 for securing the supply tube 30 to the manifold 38 and providing fluid flow from the supply tube 30 to the manifold 38.

Each manifold includes a tube 44 having open ends and a pair of plugs 46 sealing the ends of the tube 44 to form a sealed interior space 48. The manifold tube 44 is substantially straight and has a central section which is square-shaped in cross section and two end sections which are generally circular in cross-section. The central section has planar and horizontally extending top and bottom walls 50, 52 which are generally parallel and spaced apart. The central section also has planar and vertically extending front and rear walls 54, 56 which are generally parallel and spaced apart. The front and rear walls 54, 56 connect the top and bottom walls 50, 52 to form the square-shaped cross-section. It is noted that the sections of the tube 44 can have other shapes such as, for example, the central section can be rectangular or other shapes and the end section can be oval and other shapes.

The top 50 wall has a first or central opening 58 generally at the center of the tube 44 and second and third or side openings 60 spaced-apart from opposite sides of the central opening 58. Each of the openings 58, 60 in the top wall 50 are sized for receiving a mechanical fastener 60 therein such as, for example, the illustrated threaded fasteners as described in more detail hereinafter.

The bottom wall 52 has a central opening 64 substantially coaxial with the central opening 58 of the top wall 50 and second and third openings or side openings 66 which are substantially coaxial with the side openings 60 of the top wall 50. The central opening 64 of the bottom wall 52 is sized for cooperating with the inlet fitting 42 as described in more detail hereinafter. The side openings 66 of the bottom wall 52 are sized for cooperating with the valves 40 as described in more detail hereinafter.

Each of the end sections of the manifold tube 44 has an outer portion which is generally circular-shaped in cross-section and a transition portion which is compound-shaped. The diameter of the outer portion is preferably sized to be substantially equal to the diagonal length of the square central section. The length of the outer portion is sized to cooperate with one of the plugs 46 to form a gas-tight seal therebetween as discussed in more detail hereinafter. The transition portion is sized and shaped to connect the circular outer portion of the end section with the square central section.

The walls 50, 52, 54, 56 of the manifold tube are each relatively thin. Therefore, the manifold tube 44 is preferably a steel tube. Alternatively, the manifold tube 44 can be made of aluminum or any other suitable material. It has been found that a suitable wall thickness for steel is in the range of about 0.040 inches to about 0.050 inches. The length of the manifold tube 44 is relatively short. The length is preferably in the range of about 4 inches to about 6 inches and more preferably about 5 inches. The central section of the manifold tube 44 is preferably about 0.75 inches square and the end sections of the manifold tube preferably have an outer diameter of about 1 inch.

The manifold plugs 46 are preferably made of brass but alternatively can be made of aluminum or any other suitable material. Each of the manifold plugs 46 has a body section and a cap section. The body section is generally cylindrically shaped and sized and shaped for forming an interference fit with the end section of the manifold tube 44 to form a gas-tight seal therebetween. The body section preferably has at least two protrusions or ridges 68 formed therein which circumferentially extend around the body section. The ridges are preferably truncated triangles in cross-section having side surfaces which angle toward each other in a radially outward direction from the central axis 70 and terminate at an outer surface generally parallel to the central axis 70. The ridges 68 preferably have an inclusive angle of about 60 degrees. The ridges 68 also have an outer diameter which interferes with the inner diameter if the end section of the manifold tube 44. The body section has a length which corresponds to the end section of the manifold tube 44.

The cap section of the manifold plug 46 is generally cylindrically-shaped and has an outer diameter larger than body section to form an abutment 72. The outer diameter of the cap section preferably corresponds to the outer diameter of the end section of the manifold tube 44.

The two manifold plugs 46 are located in the end sections of the manifold tube 44 with the end of the manifold tube 44 engaging the abutment 72 of the manifold plug 46. The body section of the manifold plug 46 is located within the end section of the manifold tube 44 with the ridges 68 engaging the end portion of the tube end section to form a gas-tight seal therebetween.

The manifold 38 is preferably produced by first cutting a tube having the desired cross-sectional-shape (such as, for example, the illustrated square tube), the desired wall thickness, and the desired wall dimensions to a desired length. Next, a mandrel is used to open up the ends of the cut tube and form the end sections to the desired shape (such as, for example, the illustrated circular end sections) and size. A mandrel is then inserted through the tube so that the openings 58, 60, 64, 66 can be punched, drilled or otherwise formed without deforming the walls of the tube. Finally, the plugs 46 are inserted into the end sections of the manifold tube 44 and are swaged into place to form a gas-tight seal therebetween and the sealed interior space 48.

The inlet fitting 42 is a bolt-through-type fitting and has a cylindrically-shaped outer portion 74 and a cylindrically-shaped inner portion 76 extending from and coaxial with the outer portion 74. The inner portion 76 is sized and shaped to cooperate with and extend through the central opening 64 in the bottom wall 52 of the manifold tube 44. The outer portion 74 is sized larger than the inner portion 76 to form an abutment 78 therebetween.

A central passage 80 extends through the inlet fitting 42 and side openings 82 are provided in the inner portion 76 to communicate the interior space 48 of the manifold 38 with the central passage 80. A portion of the central passage 80 at the upper end of the inner portion 76 is provided with internal threads sized to cooperate with the mechanical fastener 62.

The inner portion 76 of the fitting 42 extends through the central opening 64 in the manifold tube bottom wall 52 and into the into the interior space 48 of the manifold 38. The mechanical fastener 62 extends through the central opening 58 in the manifold tube top wall 50 and into the threaded portion of the fitting central passage 80 to secure the fitting 42 to the manifold 38. A washer 84 and a first seal member 86 are provided between a head of the mechanical fastener 62 and the outer surface of the manifold tube top wall 52 to form a gas-tight seal. A second seal member 88 is provided between the abutment 78 of the fitting 42 and the outer surface of the manifold tube bottom wall 52 to form a high-pressure gas-tight seal. "High-pressure" is used herein to mean the operating pressure of the gas appliance, which typically is a maximum of ½ psi, plus a suitable safety margin. The illustrated seal members 86, 88 are flat gaskets but they can alternatively be any other suitable type such as, for example, O-rings. With the fitting 42 secured to the manifold 38 in this manner, the central openings 58, 64 of the manifold tube 44 are sealed and the central passage 80 of the fitting 42 is in fluid-flow communication with the interior space 48 of the manifold 38.

The lower end of the fitting outer portion 74 is provided with concentric first and second couterbores 90, 92 which are adapted to attach the supply tube 30 with a stake joint to form a high-pressure gas-tight seal therebetween. For a more detailed description of a stake joint see U.S. Pat. No. 3,930,298, the disclosure of which is expressly incorporated herein in its entirety. It is noted that the stake joint can include variations such as those disclosed in U.S. Pat. Nos. 3,977,710 and 4,126,929, the disclosures of which are expressly incorporated herein in their entirety.

It is noted that the supply tubes 30 can be secured and sealed with other suitable types of high-pressure gas-tight joints such as, for example, double-bead joints. For a more detailed description of double-bead joints see U.S. Pat. No. 4,871,199, the disclosure of which is expressly incorporated herein in its entirety. It is noted that double-bead joints can include variations such as those disclosed in U.S. Pat. No. 5,573,285, the disclosure of which is expressly incorporated herein in its entirety.

As best shown in FIG. 2, the supply tubes 30 extend from the common inlet line secured to the rear wall 34 of the appliance 22 to the manifold assemblies 26 located at the front wall 28 of the appliance 22. The supply tubes 30 are preferably bent in a pattern which minimizes the total number of bends and minimizes the total amount of tube required, and therefore, the total weight of the distribution system. The supply tubes 30 preferably have a relatively small outside diameter such as, for example, about ¼ inch to about ⅜ inch and preferably comprise a light weight and malleable material suitable for bending, double-bead joints and/or stake joints such as, for example, a soft aluminum alloy.

As best shown in FIGS. 3–5, manifold assembly 26 includes two of the burner valves 40. Each of the valves 40 are bolt-through-type valves having an inner portion 94 upwardly extending from an outer portion 96. The inner portion 94 is sized and shaped to cooperate with and extend through one of the side openings 66 in the bottom wall 52 of the manifold tube 44. The outer portion 96 is larger than the inner portion 94 to form an abutment 98 therebetween.

A central passage 100 extends from an internal cavity of the outer portion 96 to the top of inner portion 94 and side openings 104 are provided in the inner portion 94 to communicate the interior space 48 of the manifold 38 with the central passage 100. A portion of the central passage 100 at the upper end of the inner portion 94 is provided with internal threads sized to cooperate with the mechanical fastener 62.

The inner portion 94 of the burner valve 40 extends through the side opening 66 in the manifold tube bottom wall 52 and into the interior space 48 of the manifold 38. The mechanical fastener 62 extends through the side opening 60 in the manifold tube top wall 50 and into the threaded portion of the valve central passage 100 to secure the valve 40 to the manifold 38. A washer 106 and a first seal member 108 are provided between a head of the mechanical fastener 62 and the outer surface of the manifold tube top wall 50 to form a high-pressure gas-tight seal. A second seal member 110 is provided between the abutment 98 of the valve 40 and the outer surface of the manifold tube bottom wall 52 to form a high-pressure gas-tight seal. The illustrated seal members 106, 108 are flat gaskets but they can alternatively be any other suitable type such as, for example, O-rings. With the valves 40 secured to the manifold 38 in this manner, the side openings 60, 66 of the manifold tube 44 are sealed and the interior space 48 of the manifold 38 is in fluid-flow communication with the internal cavities 102 of the valves 40.

A known valve mechanism is located within the outer portion 96 and is manually controlled by rotation of a shaft 112 to open and close the flow path from the interior cavity 102 to an outlet 114. The shaft 112 extends from the front of the outer portion 96 and has a control knob 116 mounted thereto in a conventional manner. In the illustrated embodiment the manifold assemblies 26 are located at the appliance front wall 28 with the shafts 112 extending therethrough so that an operator has easy access to the control knobs 116.

One of the burner tubes 36 is connected the outlet 114 of the burner valve 40 at a rear side of the outer portion 96. The connection can be of any known type for providing a high-pressure gas-tight seal therebetween. Preferably, the connection is a double-bead joint as discussed hereinbefore. It is noted that the burner tubes 36 and the supply tubes 30 can have different types of joints or the same type of joints.

The burner tubes 36 extend from the manifold assemblies 26 located at the front wall 28 of the appliance 22 to the top burners 24 located in a rectangular pattern within the gas appliance 22 adjacent a top wall of the appliance 22. The burner tubes 36 are attached the top burners 24 in a conventional manner. The burner tubes 36 are preferably bent in a pattern which minimizes the total number of bends and minimizes the total amount of tube required, and therefore, the total weight of the distribution system 20. The burner tubes 36 preferably have a relatively small outside diameter such as, for example, about ⅜ inch to about ½ inch and preferably comprise a light weight and malleable material suitable for bending, double-bead joints and/or stake joints such as, for example, a soft aluminum alloy.

Figure 6:
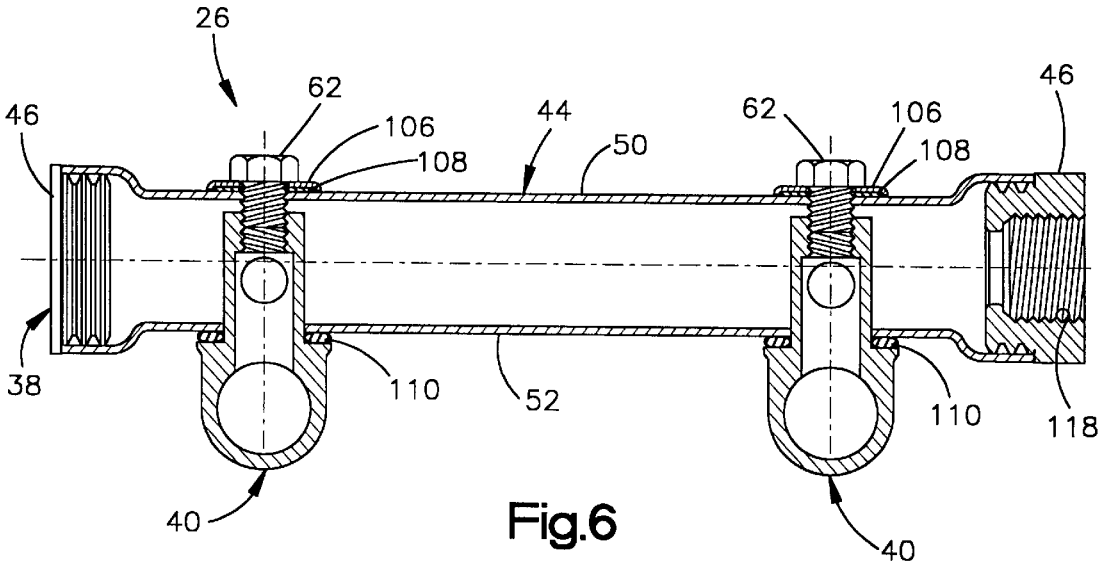
FIG. 6 is a cross-section view similar to FIG. 4 but showing an alternative embodiment of the manifold.

FIG. 6 illustrates a variation of the manifold assembly 26 of FIG. 4 wherein like reference numbers are used for like structure, and illustrates that the supply tube 30 can be connected to the manifold assembly 26 in different manners. The manifold 38 is the same as described above with regard to FIG. 4 except the central openings in the upper and lower walls are not provided and an inlet plug 46' is provided at one end of the manifold 38. The illustrated inlet plug 46' has a threaded opening 118 therethrough so that the supply tube 30 can be connected to the inlet plug 46' and provide fluid flow communication from the supply tube 30 to the interior space 48 of the manifold 38. The cap portion of the inlet plug 46' has an increased longitudinal length so that a suitable length is available for the internal threads of the opening 118. It is noted that the connection between the supply tube 30 and the inlet plug 46' can be of any suitable type providing a high-pressure gas-tight seal such as, for example, a double bead-joint as discussed hereinabove.

Although particular embodiments of the invention have been described in detail, it will be understood that the invention is not limited correspondingly in scope, but includes all changes and modifications coming within the spirit and terms of the claims appended hereto.

What is claimed is:

1. A manifold for a gas appliance comprising:

a tube having a central section, the central section having at least one flat portion extending along the length of the central section from end to end and expanded end sections located at opposite ends of said central section, the end sections having rounded cross sections;

a pair of rounded end plugs closing said end sections to form a sealed interior space within said tube, said end plugs and said end sections of said tube being sealed together to form a gas-tight seal therebetween;

at least one inlet opening for a supply tube; and at least one outlet opening for a valve.

2. The manifold according to claim 1, wherein each of said end plugs has a cylindrically-shaped body portion and a cylindrically shaped cap portion, said cap portion having an outer diameter larger than an outer diameter of said body portion to form an abutment therebetween, said body portion extending into and engaging one of said end sections of said tube and said abutment engaging an end of said tube.

3. The manifold according to claim 2, wherein each of said end plugs have a plurality of circumferentially extending and longitudinally spaced-apart ridges located on said body portion.

4. The manifold according to claim 1, wherein said tube is steel.

5. The manifold according to claim 1, wherein said tube is straight.

6. The manifold according to claim 1, wherein said end plugs and said tube are swaged together.

7. A gas distribution system for an appliance comprising:

first and second manifolds each forming a sealed interior space, each manifold including a tube having a central section with at least one flat portion extending along the length of the central section from end to end and rounded expanded end sections located at opposite ends of the central section and a pair of rounded end plugs closing said end sections to form a sealed interior space within the tube;

first and second gas supply tubes, said first supply tube connected to said first manifold and said second supply tube connected to said second manifold, said supply tubes being in fluid flow communication with said hollow interior space of said manifolds;

a pair of first valves having inlets connected to said first manifold and in fluid flow communication with said hollow interior space of said first manifold;

a pair of second valves having inlets connected to said second manifold and in fluid flow communication with said hollow interior space of said second manifold; and burner tubes connected to outlets of said first valves and said second valves.

8. The gas distribution system according to claim 7, wherein each manifold includes a tube having a central section and end sections located at opposite ends of said central section, and a pair of end plugs closing said end sections to form a sealed interior space within said tube, said end plugs and said end sections of said tube being sealed together to form a gas-tight seal therebetween.

9. The gas distribution system according to claim 8, wherein said end sections and said end plugs are swaged together.

10. The gas distribution system according to claim 8, wherein each of said end plugs has a cylindrically-shaped body portion and a cylindrically shaped cap portion, said cap portion having an outer diameter larger than an outer diameter of said body portion to form an abutment therebetween, said body portion extending into and engaging one of said end sections of said tube and said abutment engaging an end of said tube.

11. The gas distribution system according to claim 10, wherein each of said end plugs have a plurality of circumferentially extending and longitudinally spaced-apart ridges located on said body portion.

12. The gas distribution system according to claim 7, wherein said first valves and said second valves are each bolt-through type valves.

13. The gas distribution system according to claim 7, further comprising bolt-through type adapters connecting said first supply tube to said first manifold and said second supply tube to said second manifold.

14. The gas distribution system according to claim 7, wherein said first and second manifolds are each substantially straight.

15. The gas distribution system according to claim 7, wherein said first and second manifolds are at least partially steel and said first and second supply tubes are aluminum alloy.

16. A gas appliance comprising:

a gas inlet;

first and second manifolds each forming a sealed interior space, each manifold including a tube having a central section with at least one flat portion extending along the length of the central section from end to end and rounded expanded end sections located at opposite ends of the central section and a pair of rounded end plugs closing said end sections to form a sealed interior space within the tube;

first and second gas supply tubes, said first supply tube connecting said inlet with said first manifold and said second supply tube connecting said inlet with to said second manifold, said supply tubes being in fluid flow communication with said hollow interior space of said manifolds;

a pair of first valves having inlets connected to said first manifold and in fluid flow communication with said hollow interior space of said first manifold;

a pair of second valves having inlets connected to said second manifold and in fluid flow communication with said hollow interior space of said second manifold;

burner assemblies; and burner tubes connecting each of said burner assemblies with an outlet of one of said first valves and said second valves.

17. The gas appliance according to claim 16, wherein each manifold includes a tube having a central section and end sections located at opposite ends of said central section, and a pair of end plugs closing said end sections to form a sealed interior space within said tube, said end plugs and said end sections of said tube being sealed together to form a gas-tight seal therebetween.

18. The gas appliance according to claim 17, wherein each of said end plugs has a cylindrically-shaped body portion and a cylindrically shaped cap portion, said cap portion having an outer diameter larger than an outer diameter of said body portion to form an abutment therebetween, said body portion extending into and engaging one of said end sections of said tube and said abutment engaging an end of said tube.

19. The gas appliance according to claim 18, wherein said end sections and said end plugs are swaged together.

20. The gas appliance according to claim 16, wherein said first valves and said second valves are each bolt-through type valves.

21. The gas appliance according to claim 16, further comprising bolt-through type adapters connecting said first supply tube to said first manifold and said second supply tube to said second manifold.

22. The gas appliance according to claim 16, wherein said first and second manifolds comprise steel and said first and second supply tubes comprise aluminum.

23. The gas appliance according to claim 16, wherein said first and second manifolds are each substantially straight.

24. A method of making a manifold for a gas appliance comprising the steps of:

cutting a tube having at least one flat portion extending from end to end to a desired length;

forming rounded expanded end sections at ends of the tube;

forming holes in a sidewall of the tube;

inserting rounded plugs into the end sections of the tube; and sealing the plugs and the tube together to form a gas-tight seal therebetween and a sealed interior space within the tube.

25. The method according to claim 24, wherein said step of forming the end sections includes the step of inserting a mandrel into the tube.

26. The method according to claim 24, wherein said step of forming the end sections includes the step of forming a generally circularly-shaped cross-section.

27. The method according to claim 24, wherein said step of sealing the plugs and the tube together includes the step of swaging the plugs and the tube together.

28. The method according to claim 24, wherein said step of forming the holes includes the step of punching holes.

29. The method according to claim 24, further comprising the step of attaching valves to the tube at the holes.

30. A manifold for a gas appliance comprising:

a tube having a straight central section having at least one flat portion extending from end to end;

expanded end sections located at opposite ends of the central section, the end sections being sealed;

a pair of end plugs closing said expanded end sections to form a sealed interior space within said tube, said end plugs and said end sections of said tube being sealed together by swaging to form a gas-tight seal therebetween; and openings for a supply tube and a valve.

31. The manifold of claim 28 wherein a gas supply tube is operatively connected to the central section and supplies gas to one of the openings.

32. The manifold of claim 29 wherein a valve is operatively connected to another of the openings.

33. The manifold of claim 30 wherein the manifold is generally cylindrically shaped, the valve is a bolt through type and the gas supply tube is connected to the central section with a bolt through adaptor.

* * * * *

UNITED STATES PATENT AND TRADEMARK OFFICE

CERTIFICATE OF CORRECTION

PATENT NO. : 5,979,430

DATED : November 9, 1999

INVENTOR(S) : Peed, et. al.

It is certified that error appears in the above-identified patent and that said Letters Patent is hereby corrected as shown below:

Column 1, line 60, please delete "communications" and insert --communication--.

Column 10, line 25, claim 31, please delete "28" and insert --30--.

Column 10, line 28, claim 32, please delete "29" and insert --31--.

Column 10, line 30, claim 33, please delete "30" and insert --32--.

Signed and Sealed this

Twenty-sixth Day of December, 2000

*Attest:*

Q. TODD DICKINSON

*Attesting Officer*

*Director of Patents and Trademarks*